US010524590B2

(12) United States Patent
Wu et al.

(10) Patent No.: US 10,524,590 B2
(45) Date of Patent: Jan. 7, 2020

(54) WRENCH SUPPORT RACK ASSEMBLY

(71) Applicant: STANLEY CHIRO INTERNATIONAL LTD, Taichung Hsien (TW)

(72) Inventors: Yen-ting Wu, Taoyuan (TW); Chihchiang Lee, Taichung (TW); Wan-chiang Wang, Taichung (TW); Yi Tung Chan, Taichung (TW); Ching-Yi Tu, Taichung (TW); Hui-Mei Chang, Taichung (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 34 days.

(21) Appl. No.: 15/690,455

(22) Filed: Aug. 30, 2017

(65) Prior Publication Data

US 2019/0059614 A1 Feb. 28, 2019

(51) Int. Cl.

| | |
|---|---|
| ***A47F 7/00*** | (2006.01) |
| ***B25H 3/00*** | (2006.01) |
| ***B25H 3/02*** | (2006.01) |

(52) U.S. Cl.

CPC ..... *A47F 7/0028* (2013.01); *B25H 3/006* (2013.01); *B25H 3/02* (2013.01)

(58) Field of Classification Search

CPC ..... A47F 7/0028; B25H 3/006; B25H 3/04; B25H 3/02; B25H 3/003

USPC ..... 206/364, 349, 377, 378, 376; 211/70.6

See application file for complete search history.

(56) References Cited

U.S. PATENT DOCUMENTS

| | | | | | |
|---|---|---|---|---|---|
| 5,346,063 | A * | 9/1994 | Chow | B25H 3/04 | 206/376 |
| 6,401,923 | B1 * | 6/2002 | Huang | B25H 3/04 | 206/376 |
| 6,679,391 | B1 * | 1/2004 | Huang | B25H 3/04 | 206/372 |
| 7,055,689 | B2 * | 6/2006 | Chen | B25H 3/04 | 206/349 |
| 7,938,261 | B1 * | 5/2011 | Lee | B65D 73/0014 | 206/349 |
| 8,047,386 | B2 * | 11/2011 | Chen | A47F 7/00 | 206/376 |
| 8,261,911 | B2 * | 9/2012 | Lee | B25H 3/04 | 206/372 |
| 2003/0010733 | A1 * | 1/2003 | Ling | A47F 7/00 | 211/70.6 |
| 2003/0183591 | A1 * | 10/2003 | Ling | A47F 7/00 | 211/70.6 |
| 2004/0000497 | A1 * | 1/2004 | Huang | B25H 3/04 | 206/376 |
| 2004/0256336 | A1 * | 12/2004 | Ling | A47F 7/00 | 211/70.6 |

(Continued)

*Primary Examiner* — Steven A. Reynolds

(74) *Attorney, Agent, or Firm* — Caeden Drayton

(57) ABSTRACT

A wrench support rack including a base, and at least one clamp assembly attached to the base and comprising a vertical stop spaced apart from a push member. The space in between the vertical stop and the push member forms a groove configured to receive a stem of a wrench. The vertical stop includes an upper ridge portion configured to engage a stem of a wrench and limit vertical movement of a wrench disposed in the groove. The push member includes an inward protrusion configured to press a stem of a wrench in to the vertical stop and limit horizontal movement of a wrench disposed in the groove.

13 Claims, 6 Drawing Sheets

(56) References Cited

U.S. PATENT DOCUMENTS

2017/0274522 A1* 9/2017 Kao ..... B25H 3/04

* cited by examiner

WRENCH SUPPORT RACK ASSEMBLY

FIELD OF THE INVENTION

The present invention relates to a wrench support rack assembly, and more particularly to a wrench support rack assembly having a plurality of clamps for holding wrenches in place for display and preventing unwanted removal.

BACKGROUND OF THE INVENTION

Hand tools, such as wrenches, are generally marketed as a set of tools that are arranged on a support rack assembly. This support rack assembly is subsequently used in workshops to arrange the set of tools and check for the presence of all of the tools. A conventional wrench support rack assembly includes a support rack, a retention cover and a fastener clip. The support rack includes a base with two opposite sides and a left and right side plates extended respectively and upwardly from the opposite sides of the base to define a wrench receiving space there between.

An example of a typical wrench support rack assembly can be found in U.S. Pat. No. 6,679,391. This describes a wrench support rack assembly that includes aligned first and second confining members. Each of the confining members defines a groove, and has opposing first and second groove defining faces confining the groove and spaced apart from each other by a first distance. A series of L-shaped legs and an abutment face uses friction to hold the wrenches in place. Because this design uses friction to hold the wrenches in place. The length axis and width axis of the wrenches cannot be fixed. Therefore, only a limited range of wrenches can be held in the support rack.

Other prior art wrench rack designs may use friction coupled with a vertical stop to hold the wrenches in place. These designs include a base with left and right sides, and left and right rows of retaining members extending uprightly and respectively from the left and right sides of the base. An adjacent pair of the left retaining members cooperatively define a first retaining groove. An adjacent pair of the right retaining members cooperatively define a second retaining groove that is aligned with the first retaining groove in a transverse direction relative to the length of the base such that a stem of a wrench can be retained in the first and second grooves. These designs cannot take into account the manufacturing tolerances of the wrenches. Therefore, the wrenches may shake while in the wrench support rack.

The present invention overcomes one or more of the drawbacks of the aforementioned designs.

BRIEF SUMMARY OF THE INVENTION

A wrench support rack including a base, and at least one clamp assembly attached to the base and comprising a vertical stop spaced apart from a push member. The space in between the vertical stop and the push member forms a groove configured to receive a stem of a wrench. The vertical stop includes an upper ridge portion configured to engage a stem of a wrench and limit vertical movement of a wrench disposed in the groove. The push member includes an inward protrusion configured to press a stem of a wrench in to the vertical stop and limit horizontal movement of a wrench disposed in the groove.

BRIEF DESCRIPTION OF THE DRAWINGS

An embodiment of the invention will now be described by way of example with reference to the drawings in which.

DETAILED DESCRIPTION OF THE INVENTION

Figure 1:
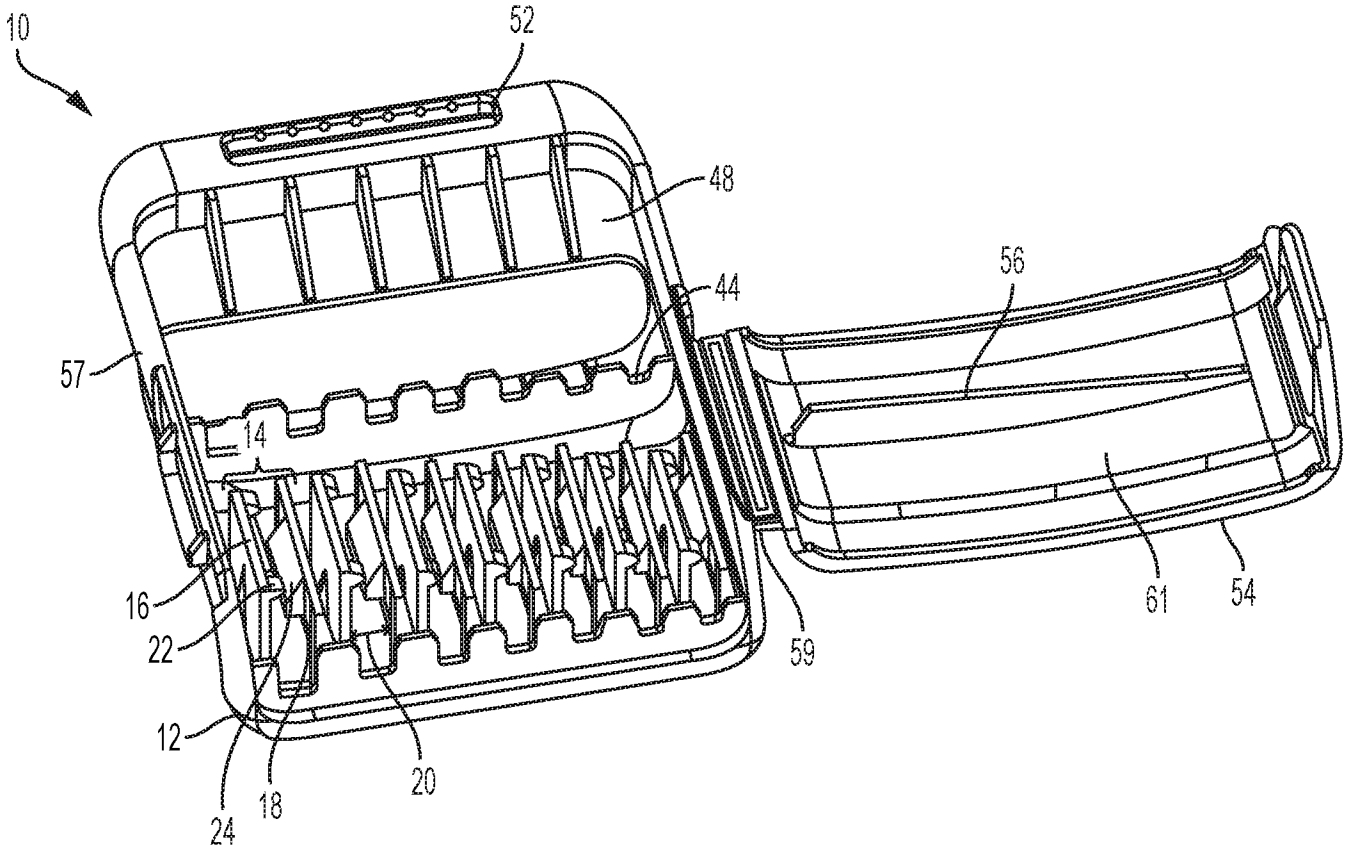
FIG. 1 is a perspective view of first embodiment of a wrench support rack according to the invention.
Figure 2:
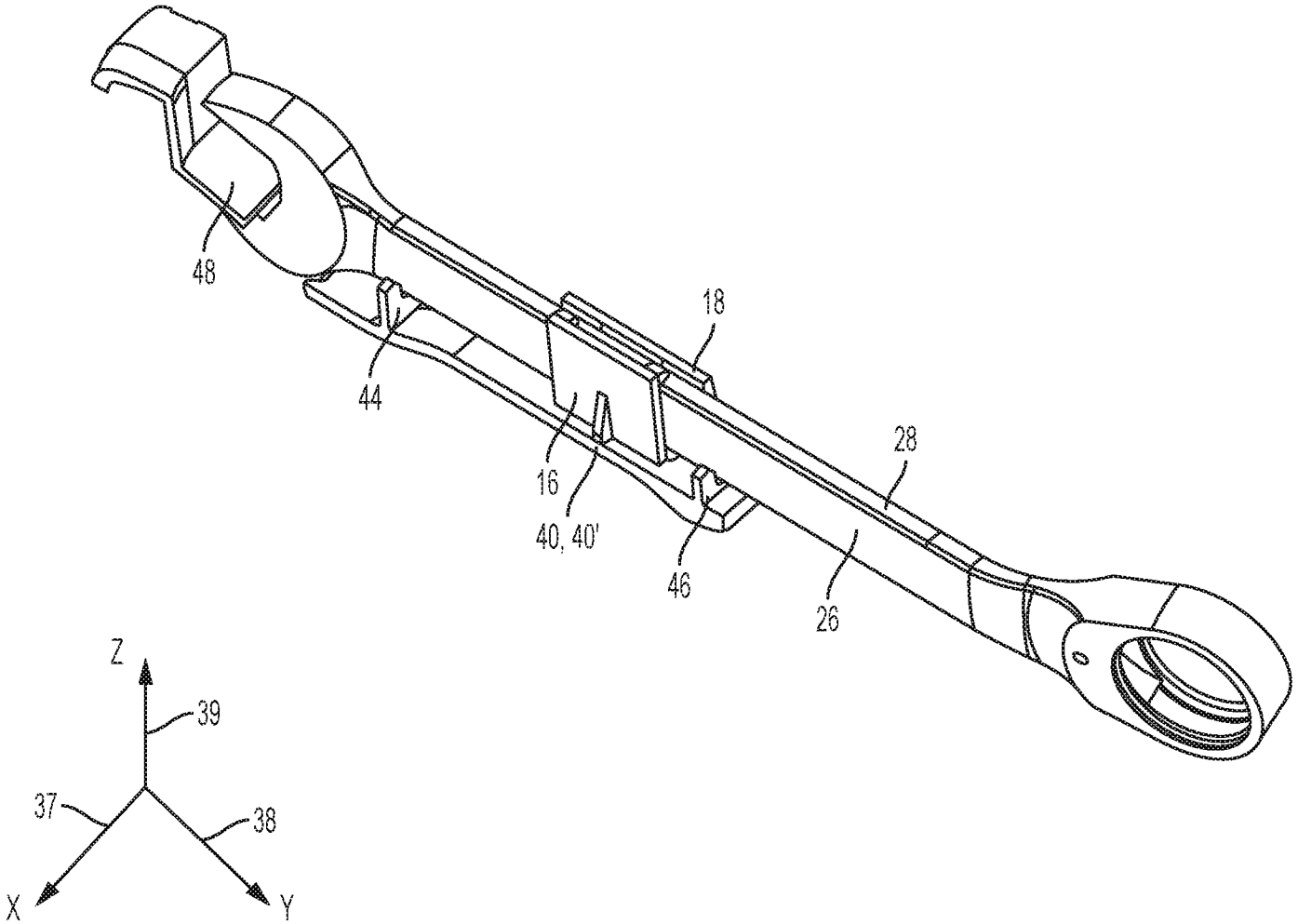
FIG. 2 is a perspective view of a cutaway portion of a wrench support rack showing a wrench positioned therein.
Figure 3:
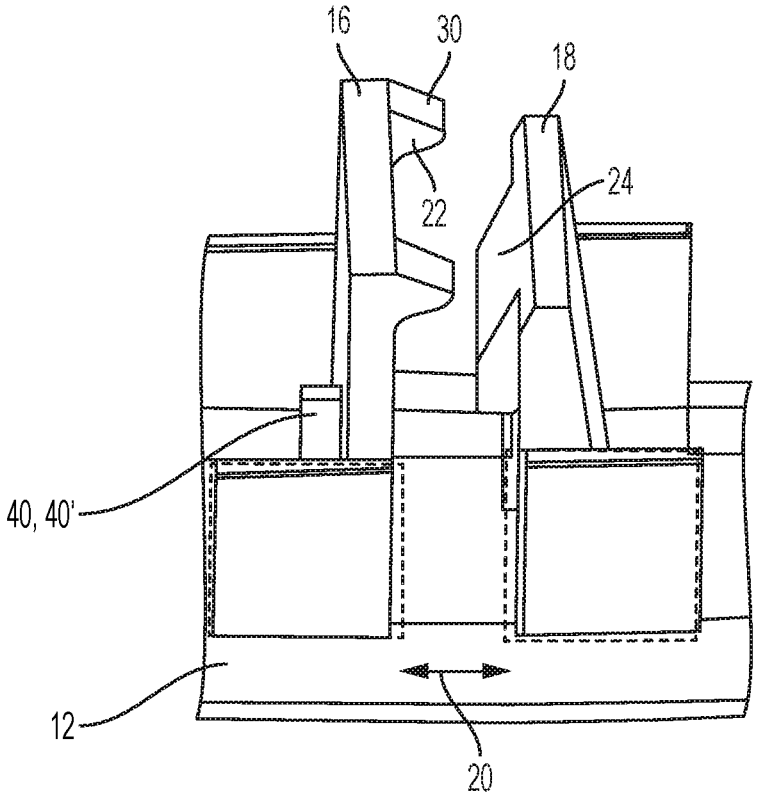
FIG. 3 is perspective view of a clamp assembly.

FIG. 1 discloses an embodiment of the wrench rack support 10. The wrench support rack includes a base 12. A clamp assembly 14 is attached to the base 12. The clamp assembly 14 comprises a vertical stop 16 spaced apart from a push member 18. The space in between the vertical stop 16 and the push member 18 forms a groove 20 configured to receive a stem 26 of a wrench 28. (For ease of discussion about the position in which the clamp assembly 14 holds the wrench 28, the axis' of the wrench 28 are also shown in FIG. 2. When held in position in the clamp assembly 14, the z-axis 39 will be vertical.)

As shown in FIG. 2, the clamp assembly 14 is configured to rigidly hold the stem 26 of a wrench 28 in place thereby preventing unwanted removal. The vertical stop 16 includes at least one upper ridge portion 22 that is configured to engage the stem 26 of a wrench 28. The vertical stop 16 may also include two upper ridge portions 22, both of which will engage the stem 26 of a wrench 28 and prevent vertical movement of the wrench 28.

Opposite the vertical stop 16 is a push member 18. The push member 18 includes at least one inward protrusion 24. The push member 18 and the inward protrusion 24 are configured to engage the stem 26 of a wrench 28 and push/hold it into engagement with the vertical stop 16.

Figure 5:
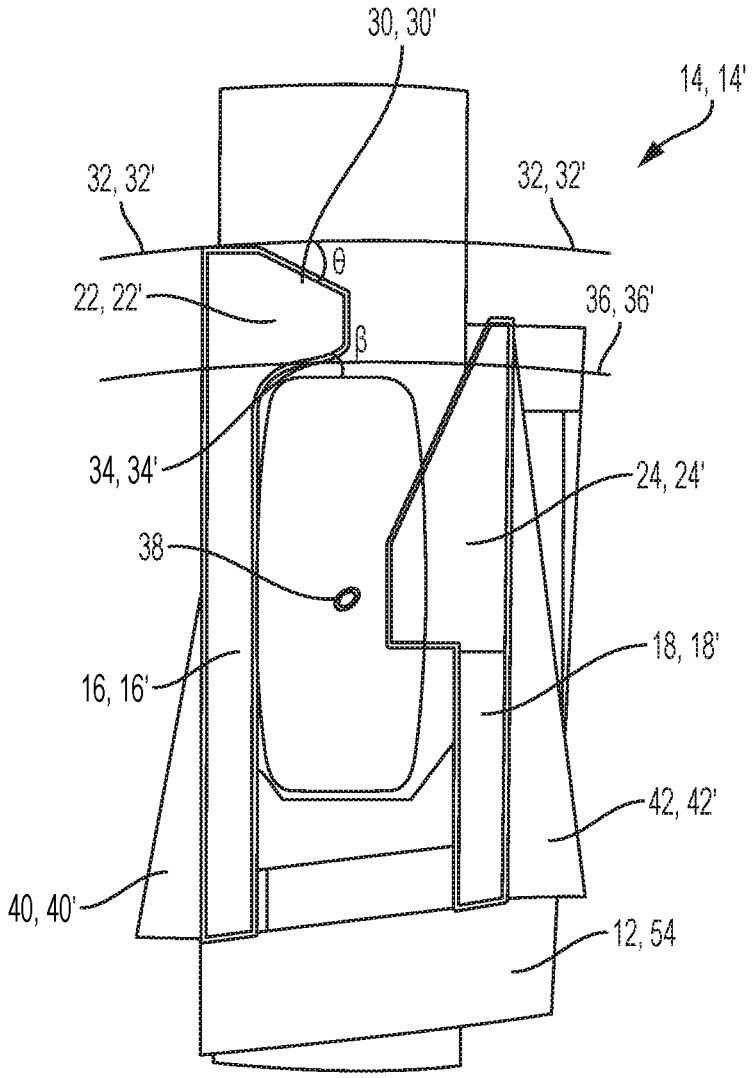
FIG. 5 is cutaway view showing a stem of a wrench positioned in a clamp assembly.
Figure 6:
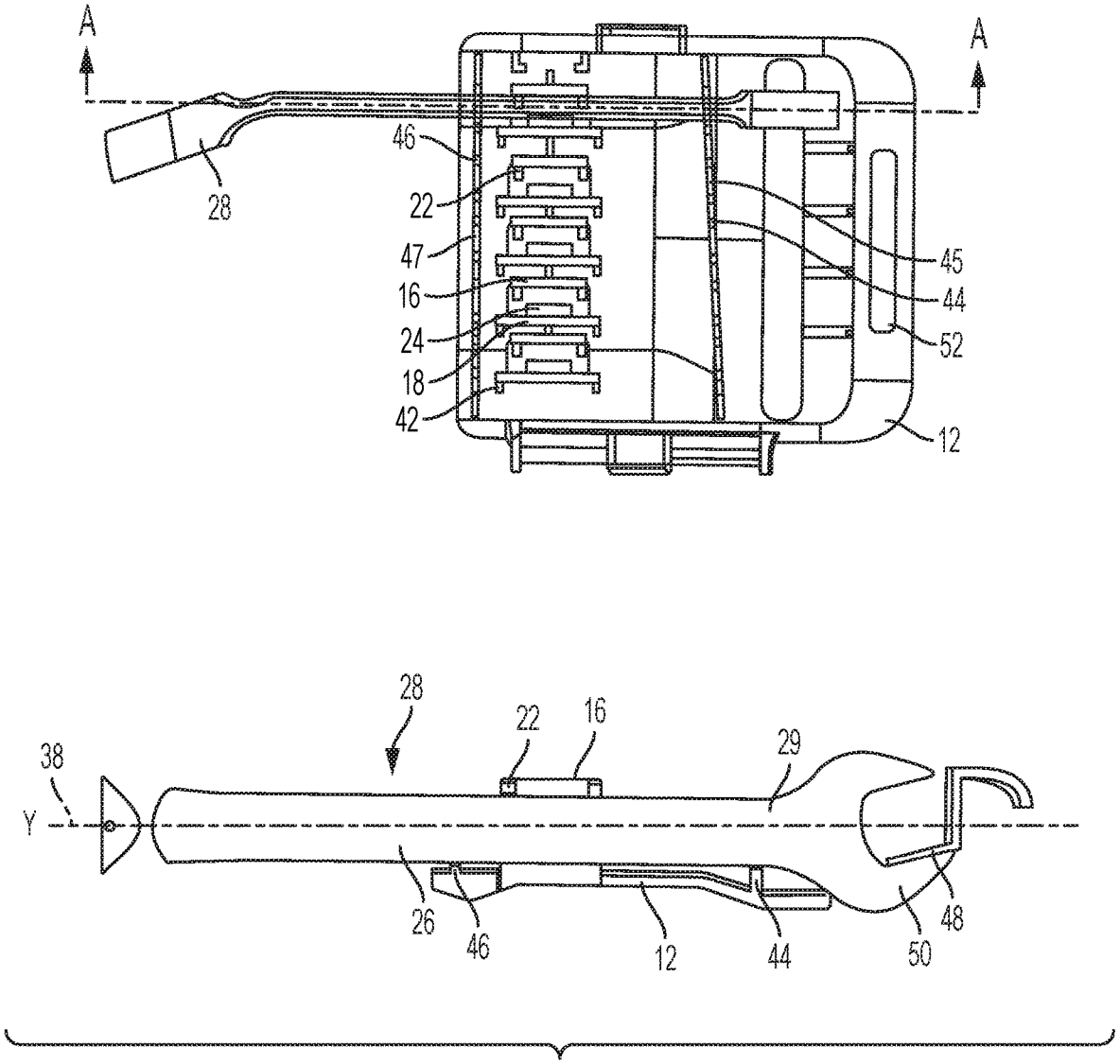
FIG. 6 is a plan view of a wrench disposed in a wrench rack support and a cutaway view of the same.

Turning now to FIG. 5, which is a cutaway of an exemplary clamp assembly 14 holding a wrench 28 in place. As previously mentioned, the vertical stop 16 includes at least one upper ridge portion 22. Generally speaking, the upper ridge portion 22 is substantially pennant or triangular shaped. This general pennant or triangular shape is formed from an upper surface 30 that is positioned at a downward angle ($\theta$) when measured from its normal 32, and a lower surface 34 that is positioned at an upward angle ($\beta$) when measured from its normal 36. Preferably, it should be easier to insert a wrench 28 into the clamp assembly 14 than it is to remove it. In order to achieve this preference, the angle ($\theta$) of the upper surface 30 should always be greater than the angle ($\beta$) of the lower surface 34.

FIG. 5 also shows the position of the inward protrusion 24 and how it assists in holding a wrench in place. Specifically, the inward protrusion 24 is configured to engage the stem 26 of a wrench 28 substantially at or above the y-axis 38 of the wrench. In so doing, the inward protrusion applies a force (represented by arrow 41) at a downward angle. This force holds the wrench in place against both the base 12 and the vertical stop 16.

Figure 4:
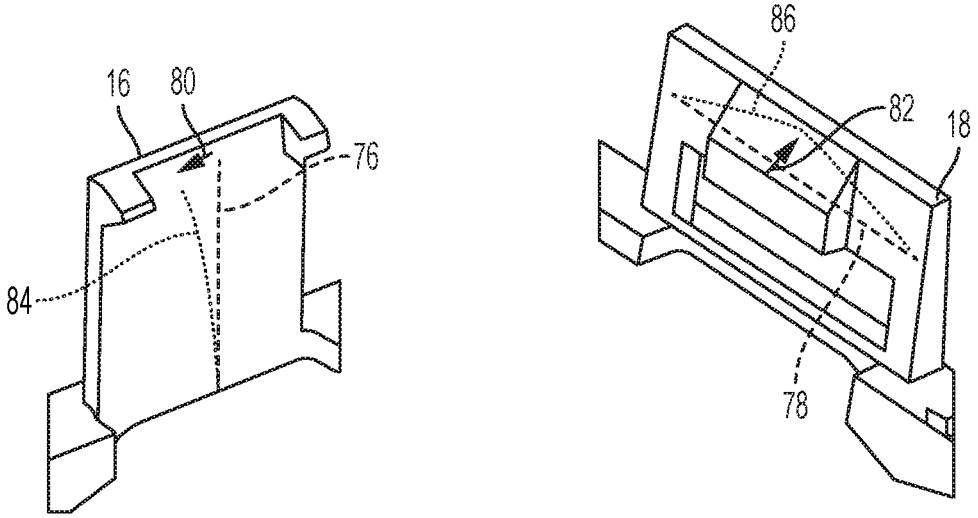
FIG. 4 is an exploded view of a clamp assembly.

Over the life of the product, the insertion and removal of wrenches from the clamp assembly 14 may lead to a bending/bowing of the material used to craft the vertical stop 16 and push member 18. FIG. 4 shows the manner in which the vertical stop 16 and the push member 18 may bend/bow.

The thick broken lines 76, 78 represent the respective vertical positions of the vertical stop 16 and push member 18 when there is not a wrench positioned there between. When a wrench is positioned in between the vertical stop 16 and the push member 18, forces represented by arrows 80, 82 are applied. These forces 80, 82 cause the vertical stop 16 and push member 16 to respectively bend and bow as represented by the thin broken lines 84, 86. Over time, this repetitive bending/bowing may cause the vertical stop 16 and push member 18 to permanently stay in these respective bent/bowed positions. In order to prevent this from happening, support ribs 40, 42 may optionally be attached to the vertical stop 16 and/or the push member 18. (See FIG. 5). If used, support ribs 40, 42 would be attached to the base 12 and the respective sides of the vertical stop 16 and push member 18 that are opposite the groove 20.

In addition to the clamp assembly 14, the base 12 of the wrench support rack 10 may also include one or more ribs that are designed to support a wrench disposed in groove 20. For example, neck support rib 44 may include a recess 45 that is configured to receive a neck 29 of a wrench 28. When a neck 29 of a wrench 28 is positioned in recess 45, the downward motion of the wrench 28 is limited. A rear support rib 46 may also be attached to the base 12. Similar to the neck support rib 44, the rear support rib 46 may also include a recess 47 that is configured to support a stem 26 of a wrench 28. When a stem 26 of a wrench 28 is positioned in recess 47, the downward movement of wrench 28 is limited. In a preferred embodiment, the neck support rib 44 and the rear support rib 46 are spaced apart and the clamp assembly 14 is disposed there between.

The base 12 may also include an open head support 48. More specifically, the open head support may be integral to the base 12. The open head support 48 is configured to engage a single tine 50 of a wrench 28. When a tine 50 of a wrench 28 is engaged to the open head support 48, the upward movement of the wrench 28 is limited by the open head support 48.

For added security, the wrench support rack 10 may also include a retention door 54. The retention door 54 may be pivotally attached to a side 55 of the base 12 and is configured to move between an open position and a closed position wherein the retention door 54 pivots over the top of the clamp assembly 14. When in a closed position, the retention door 54 may be secured to another side 57 of the base 12. Those skilled in the art will recognize that the pivot 59 of the retention door 54 may be achieved in a variety of known methods.

As shown in FIG. 1, the retention door 54 may also include a horizontal rib 56. The horizontal rib 56 may be attached to an interior side 61 of the retention door 54. The horizontal rib 56 may be configured to engage a stem 26 of a wrench 28 when the retention door 54 is in a closed position. This engagement provides an additional measure of security thereby further preventing unwanted movement of wrenches disposed in the wrench rack support 10. The horizontal rib 56 may be tapered such that when the retention door 54 is closed, the horizontal rib 56 may engage multiple wrenches of varying sizes.

Figure 7:
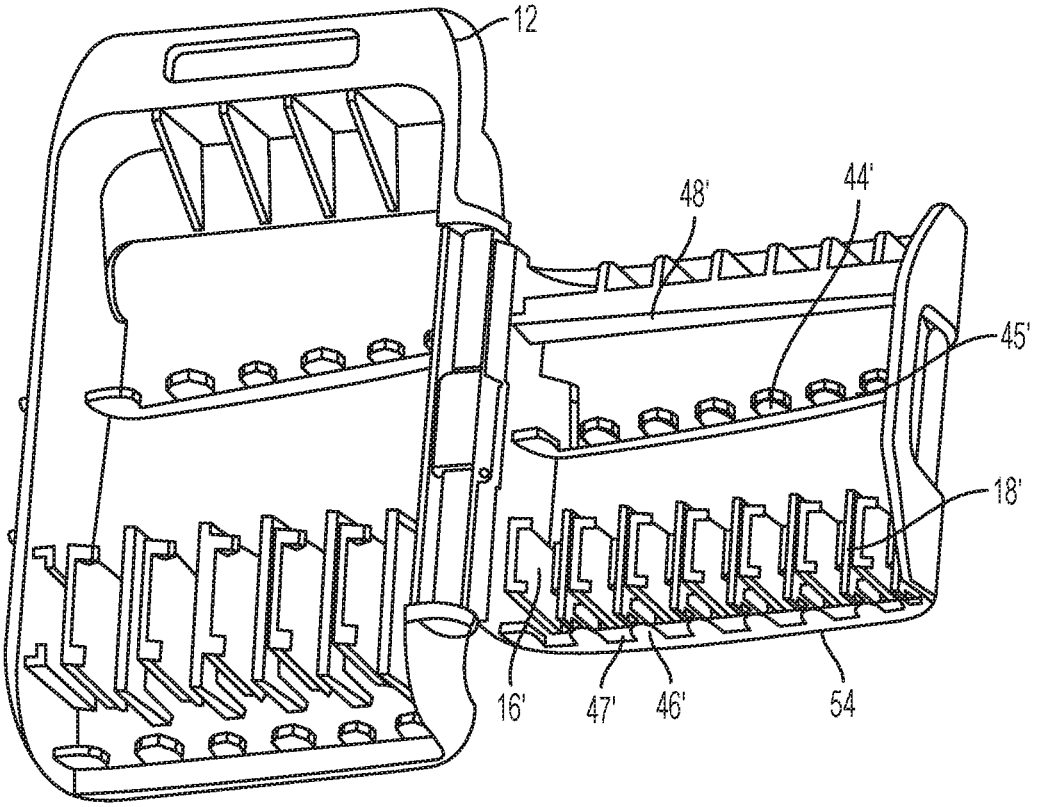
FIG. 7 is an alternate embodiment of the wrench support rack according to the invention.

In an alternate embodiment, as shown in FIG. 7, the retention door 54 does not include a horizontal rib 56. Instead, the interior side 61 of the retention door 54 includes at least one door clamp assembly 14'. The door clamp assembly 14' functions identically to that of the clamp assembly 14 discussed above. For ease of explanation, similar elements will be given the same reference numeral. However, door related items will be labelled with a prime. The door clamp assembly 14' comprises a door vertical stop 16' spaced apart from a door push member 18'. The space between the door vertical stop 16' and the door push member 18' forms a door groove 20' configured to receive a stem of a wrench. The door vertical stop 16' includes an upper ridge portion 22' configured to engage a stem of a wrench and limit vertical movement of a wrench disposed in the door groove 20'. The door push member 18' includes an inward protrusion 24' configured to press a stem of a wrench in to the door vertical stop 16' and limit horizontal movement of a wrench disposed in the door groove 20'.

As shown in FIG. 5, the upper ridge portion 22' of the door vertical stop 16' is substantially pennant or triangular shaped. This general pennant or triangular shape is formed from an upper surface 30' that is positioned at a downward angle (θ) when measured from its normal 32', and a lower surface 34' that is positioned at an upward angle (β) when measured from its normal 36'. Preferably, it should be easier to insert a wrench 28 into the door clamp assembly 14' than it is to remove it. In order to achieve this preference, the angle (θ) of the upper surface 30' should always be greater than the angle (β) of the lower surface 34'.

FIG. 5 also shows the position of the inward protrusion 24' and how it assists in holding a wrench in place. Specifically, the inward protrusion 24' is configured to engage the stem 26 of a 28 wrench substantially at or above the y-axis 38 of the wrench. In so doing, the inward protrusion 24' applies a force (represented by arrow 41) at a downward angle. This force holds the wrench in place against both the retention door 54 and the door vertical stop 16'. Over the life of the product, the insertion and removal of wrenches from the door clamp assembly 14' may lead to a bending or bowing of the material used to craft the door vertical stop 16' and door push member 18'. Therefore, support ribs 40', 42' may optionally be attached to the door vertical stop 16' and/or the door push member 18'. If used, support ribs 40', 42' would be attached to the retention door 54 and the respective sides of the door vertical stop 16' and door push member 18' that are opposite the door groove 20'.

In addition to the door clamp assembly 14', the retention door 54 of the wrench support rack may also include one or more support ribs that are designed to support a wrench disposed in door groove 20'. For example, door neck support rib 44' may include a recess 45' that is configured to receive a neck 29 of a wrench 28. When a neck 29 of a wrench 28 is positioned in recess 45', the downward motion of the wrench 28 is limited. A door rear support rib 46' may also be attached to the retention door 54. Similar to the door neck support rib 44', the door rear support rib 46' may also include a recess 47' that is configured to support a stem 26 of a wrench 28. When a stem 26 of a wrench 28 is positioned in recess 47', the downward movement of wrench 28 is limited. In a preferred embodiment, the door neck support rib 44' and the door rear support rib 46' are spaced apart and the door clamp assembly 14' is disposed there between.

The retention door 54 may also include an door open head support 48'. The door open head support 48' may be integral to the retention door 54. The door open head support 48' is configured to engage a single tine 50 of a wrench 28. When a tine 50 of a wrench 28 is engaged to the open head support 48', the upward movement of the wrench 28 is limited by the door open head support 48'.

Persons with ordinary skill in the art will recognize that the wrench rack support 10 disclosed herein may have multiple clamp assemblies 14, 14' to accommodate multiple wrenches of varying sizes. In order to achieve this, the clamp assemblies 14, 14' will also vary in size according to the sizes of the wrenches to be accommodated. Similarly, the recess 45,45' of neck support rib 44/door neck support rib 44' and the recess 47, 47' of rear support rib 46/door rear support rib 46' may also vary in size to accommodate multiple wrenches of varying size. The open head support 48/door open head support 48', however, will not vary in size to accommodate wrenches of varying size. Instead, the varying sizes of recesses 45, 45', 47, 47' will raise and lower the wrenches of varying size so that the tines of the same all engage the same open head support 48/door open head support 48'.

INDUSTRIAL APPLICABILITY

The wrench support rack 10 disclosed herein is designed to hold one or more wrenches rigidly in place and prevent unwanted movement of the same. In order to achieve this, a user will position a wrench in her hand such that the z-axis 39 is substantially vertical. The user will then insert the head 49 of the wrench 28 into the wrench support rack 10 such that a tine 50 is beneath the open head support 48. Wrench 28 may then be rotated such that tine 50 is moved upward so that it is engaged with the open head support 48. At this point, the stem 26 of the wrench 28 is pushed downward until it comes into contact with the clamp assembly 14. Specifically, the stem 26 will be in contact with both the upper surface 30 of the vertical stop 16 and the inward protrusion 24 of the push member 18. As the user applies downward pressure to the stem 26, it will slide down the upper surface 30 and the inward protrusion 24 into groove 20. Once the stem 26 clears the upper surface 30 and is moved down into groove 20, the inward protrusion 24 will press the stem underneath the upper ridge portion 22. Preferably, the clamp assembly 14 is sized appropriately such when the stem 26 of the wrench is pressed fully into the groove 20, tine 50 will be engaged to the open head support 48; the neck 29 will be engaged to recess 45 of the neck support rib 44; and the stem will be in simultaneous contact with the lower surface 34 of the upper ridge portion 22, the inward protrusion 24, the base 12, and the recess 47 of the rear support rib 46. Obviously, removal of a wrench 28 from the wrench rack support 10 is achieved by reversing the aforementioned steps.

Those skilled in the art will recognize that the foregoing discussion of relating to the insertion and removal of a wrench into a clamp assembly on the base, is equally applicable to the insertion and removal of a wrench into a door clamp assembly described above and shown in FIG. 7.

While the present invention has been described in connection with what is considered the most practical and preferred embodiments, it is understood that this invention is not limited to the disclosed embodiments but is intended to cover various arrangement included within the spirit and scope of the broadest interpretation of the attached claims so as to encompass all such modifications and equivalent arrangements.

We claim:

1. A wrench support rack comprising:

a base, wherein the base includes an open head support configured to engage at least one tine of a wrench; and at least one clamp assembly attached to the base and comprising a vertical stop spaced apart from a push member, and wherein the space in between the vertical stop and the push member forms a groove configured to receive a stem of a wrench, and wherein the push member includes a support rib attached to the base and the side of the push member that faces away from the groove, and wherein the vertical stop includes an upper ridge portion configured to engage a stem of a wrench and limit vertical movement of a wrench disposed in the groove, and wherein the push member includes an inward protrusion configured to press a stem of a wrench in to the vertical stop and limit horizontal movement of a wrench disposed in the groove, and wherein the upper ridge portion of the vertical stop is substantially pennant shaped and includes an upper surface that is positioned at a downward angle (θ) from a normal, and a lower surface that is positioned at an upward angle (β) from a normal, and wherein the angle (θ) is greater than the angle (β);

a retention door pivotally attached to a side of the base and configured to move between an open position and a closed position wherein the retention door pivots over the top of the at least one clamp assembly and is secured to the opposite side of the base; and wherein the base further includes a neck support rib configured to support a neck of a wrench disposed in the groove and limit downward movement of the wrench, and wherein the base includes a rear support rib configured to support a stem of a wrench disposed in the groove and limit downward movement of the wrench.

2. The wrench support rack of claim 1, wherein the inward protrusion of the push member is configured to primarily engage a stem of a wrench at or above its y-axis such that the wrench is pressed downward into the push member and the base.

3. The wrench support rack of claim 1, wherein the vertical stop includes a support rib attached to the base and the side of the vertical stop that faces away from the groove.

4. The wrench support rack of claim 1, wherein the base further defines an aperture configured to receive one or more rails from a hanging sales display rack.

5. The wrench support rack of claim 1, wherein the retention door further includes a horizontal rib attached to an interior side of the retention door and configured to engage at least one stem of a wrench when the retention door is in a closed position.

6. The wrench support rack of claim 1, wherein the retention door further includes at least one door clamp assembly attached to an interior side of the retention door and comprising a door vertical stop spaced apart from a door push member, and wherein the space in between the door vertical stop and the door push member forms a door groove configured to receive a stem of a wrench, and wherein the door vertical stop includes an upper ridge portion configured to engage a stem of a wrench and limit vertical movement of a wrench disposed in the door groove, and wherein the door push member includes an inward protrusion configured to press a stem of a wrench in to the door vertical stop and limit horizontal movement of a wrench disposed in the door groove.

7. The wrench support rack of claim 6, wherein the upper ridge portion of the door vertical stop is substantially pennant shaped and includes an upper surface that is positioned at a downward angle (θ) from a normal, and a lower surface that is positioned at an upward angle (β) from a normal, and wherein the angle (θ) is greater than the angle (β).

8. The wrench support rack of claim 6, wherein the inward protrusion of the door push member is configured to primarily engage a stem of a wrench at or above its y-axis such that the wrench is pressed downward into the door push member and the door.

9. The wrench support rack of claim 6, wherein the door vertical stop includes a support rib attached to the interior side of the door and the side of the door vertical stop that faces away from the door groove.

10. The wrench support rack of claim 9, wherein the door push member includes a support rib attached to the interior side of the door and the side of the door push member that faces away from the door groove.

11. The wrench support rack of claim 10, wherein the retention door further includes at least one door rear support rib configured to support a stem of a wrench disposed in the door groove and limit downward movement of the wrench.

12. The wrench support rack of claim 11, wherein the retention door includes a door neck support rib configured to support a neck of a wrench disposed in the door groove and limit downward movement of the wrench.

13. The wrench support rack of claim 12, wherein the retention door further includes a door open head support configured engage a tine of a wrench and limit upward movement of the wrench.

* * * * *